US006978479B2

(12) United States Patent
Thach

(10) Patent No.: US 6,978,479 B2
(45) Date of Patent: Dec. 27, 2005

(54) GARMENT FOR PREVENTING A BABY FROM ROLLING OVER

(75) Inventor: Bradley T. Thach, Kirkwood, MO (US)

(73) Assignee: Washington University, St. Louis, MO (US)

( * ) Notice: Subject to any disclaimer, the term of this patent is extended or adjusted under 35 U.S.C. 154(b) by 74 days.

(21) Appl. No.: 10/632,282

(22) Filed: Aug. 1, 2003

(65) Prior Publication Data

US 2005/0022284 A1 Feb. 3, 2005

(51) Int. Cl.[7] ..... A41B 13/06
(52) U.S. Cl. ..... 2/69.5; 2/111; 5/655
(58) Field of Search ..... 2/69, 69.5, 80, 2/75, 455, 456, 44, 45, 49.3, 83, 89, 92, 114; 5/482, 494, 499, 655; D24/193

(56) References Cited

U.S. PATENT DOCUMENTS

| | | | | | |
|---|---|---|---|---|---|
| 965,921 | A | | 8/1910 | Mercey | |
| 1,573,446 | A | * | 2/1926 | Popham | 128/874 |
| 1,725,031 | A | * | 8/1929 | Ward | 128/873 |
| 1,940,224 | A | | 12/1933 | Munro | |
| 2,008,919 | A | | 7/1935 | Milkes | |
| 2,213,754 | A | | 9/1940 | Thirring | |
| 2,215,951 | A | * | 9/1940 | Astrove | 2/114 |
| 2,325,097 | A | * | 7/1943 | Behringer | 128/873 |
| 2,376,617 | A | * | 5/1945 | O'Reilley | 2/69.5 |
| 2,419,989 | A | * | 5/1947 | Day | 2/114 |
| 2,481,741 | A | * | 9/1949 | Graves | 128/873 |
| 2,531,716 | A | * | 11/1950 | Wolf | 128/873 |
| 2,546,057 | A | | 3/1951 | Bodin et al. | |
| 2,675,552 | A | | 4/1954 | Jackson | |
| 2,676,319 | A | | 4/1954 | Davidson et al. | |
| 2,720,661 | A | | 10/1955 | Harris | |
| 2,888,009 | A | | 5/1959 | Taylor | |
| 3,096,759 | A | | 7/1963 | Coolbaugh | |
| 3,721,434 | A | * | 3/1973 | Spies | 5/655 |
| 3,739,399 | A | | 6/1973 | Sheahon | |
| 3,845,513 | A | | 11/1974 | Hubner | |
| 3,987,505 | A | * | 10/1976 | Hickey | 2/114 |
| 4,202,052 | A | | 5/1980 | Bilanzich | |
| 4,471,767 | A | * | 9/1984 | Guimond | 601/5 |
| 4,611,353 | A | | 9/1986 | Als et al. | |
| 4,646,365 | A | | 3/1987 | Surprise et al. | |
| 4,773,101 | A | | 9/1988 | Kapp et al. | |

(Continued)

FOREIGN PATENT DOCUMENTS

WO WO 02/098263 A1 * 6/2002 ..... A47D 13/08

(Continued)

*Primary Examiner*—Alissa L. Hoey
(74) *Attorney, Agent, or Firm*—Sonnenschein Nath & Rosenthal LLP

(57) ABSTRACT

A garment for swaddling a baby includes an elongate shell having an outer surface, and an inner surface opposite the outer surface defining an interior volume for receiving the arms, legs, and trunk of a baby therein. The shell has a head end, a foot end opposite the head end, lateral sides extending between the head end and the foot end, and a neck opening at the head end for receiving a neck of the baby. The garment also includes a backboard attached to the elongate shell between the head end and the foot end for preventing the baby from rolling over when the baby is swaddled within the elongate shell. The backboard includes an elongate body for supporting a trunk of the baby. The body has a first face facing the baby when the baby is swaddled within the elongate shell and a second face opposite the first face.

10 Claims, 7 Drawing Sheets

U.S. PATENT DOCUMENTS 4,802,244 A * 2/1989 McGrath-Saleh ..... 2/69
4,897,885 A 2/1990 Lunt
5,014,376 A 5/1991 Doran et al.
5,016,650 A 5/1991 Marlar
5,129,406 A * 7/1992 Magnusen et al. ..... 128/873
5,131,096 A 7/1992 Olson
5,293,646 A 3/1994 Winston
5,367,709 A 11/1994 Teasley
5,412,813 A 5/1995 Hosley
5,418,979 A * 5/1995 Senderowicz ..... 2/75
5,494,052 A * 2/1996 Grohman ..... 128/873
5,551,108 A 9/1996 Butler
5,606,744 A * 3/1997 Lindy ..... 2/467
5,781,946 A * 7/1998 McEntire et al. ..... 5/482
5,826,287 A * 10/1998 Tandrup ..... 5/655
5,857,232 A * 1/1999 Mahdavi ..... 5/655
5,933,886 A * 8/1999 Washington ..... 5/494
5,950,261 A 9/1999 Hay et al.
5,988,742 A * 11/1999 Stevens ..... 297/219.12
6,009,874 A * 1/2000 Sartin et al. ..... 128/869
6,055,686 A 5/2000 Knight
6,145,932 A * 11/2000 Hamel-Nyhus et al. ..... 297/465
6,256,803 B1 * 7/2001 Sauerbrei et al. ..... 4/443
6,269,503 B1 * 8/2001 Betker ..... 5/655
6,378,445 B1 * 4/2002 Willard et al. ..... 108/115
6,381,785 B1 * 5/2002 Mancera Browne et al. ... 5/655
6,389,624 B1 * 5/2002 Madole ..... 5/655
6,393,612 B1 5/2002 Thach et al.
6,421,856 B1 * 7/2002 Furnback ..... 5/655
6,454,352 B1 * 9/2002 Konovalov et al. .... 297/219.12
2004/0045089 A1 * 3/2004 Zucker et al. ..... 5/655
2004/0177446 A1 * 9/2004 Robb et al. ..... 5/655

FOREIGN PATENT DOCUMENTS

WO WO 02/087369 11/2002

* cited by examiner

GARMENT FOR PREVENTING A BABY FROM ROLLING OVER

BACKGROUND OF THE INVENTION

The present invention relates generally garments for babies, and more specifically to a garment for preventing a baby from rolling over.

Because of the increased risk of Sudden Infant Death Syndrome (SIDS) for babies resting on their stomachs, it is desirable to place babies on their back while they rest. However, many babies have trouble resting comfortably on their back, and thus may roll over onto their stomach. Additionally, when a baby is having difficulty resting and sleeping on its back, some parents lay the baby on its stomach or side to calm the baby. Swaddling may help babies rest more comfortably on their backs, however, even when swaddled many babies can roll over onto their stomach as they rest.

SUMMARY OF THE INVENTION

In one aspect, the present invention includes a garment for swaddling a baby including an elongate shell having an outer surface, and an inner surface opposite the outer surface defining an interior volume for receiving the arms, legs, and trunk of a baby therein. The shell has a head end, a foot end opposite the head end, lateral sides extending between the head end and the foot end, and a neck opening at the head end for receiving a neck of the baby. The garment also includes a backboard attached to the elongate shell between the head end and the foot end for preventing the baby from rolling over when the baby is swaddled within the elongate shell. The backboard includes an elongate body for supporting a trunk of the baby. The body has a first face facing the baby when the baby is swaddled within the elongate shell and a second face opposite the first face.

In another aspect, the present invention includes a backboard for preventing a baby from rolling over when the baby is swaddled within a garment. The backboard includes an elongate body extending between a head end and a foot end opposite the head end. The body has a first face and a second face opposite the first face. The backboard also includes a plurality of openings within the elongate body adjacent a peripheral edge of the body for attaching the backboard to the garment. The body is attachable to the garment so the body generally supports a trunk of the baby and the first face faces the baby when the baby is swaddled within the garment. A flexible hinge is positioned on the body between the head end and the foot end for facilitating positioning the baby within the garment. An extension extends generally laterally from the body for preventing the baby from rolling over when the backboard is positioned on a surface so the second face faces the surface.

In yet another aspect, the present invention includes a backboard for preventing a baby from rolling over when the baby is swaddled within a garment. The backboard includes an elongate body extending between a head end and a foot end opposite the head end. The body has a first face and a second face opposite the first face. The body is attachable to the garment so the body generally supports a trunk of the baby and the first face faces the baby when the baby is swaddled within the garment. A flexible hinge is positioned on the body between the head end and the foot end for facilitating positioning the baby within the garment. A headboard extends from the head end of the body for supporting a head of the baby when the baby is swaddled within the garment. The headboard has a first face facing the head of the baby when the baby is swaddled within the garment, a second face opposite the first face, and a cushion positioned on the headboard first face for cushioning the head of the baby. An extension extends generally laterally from the body for preventing the baby from rolling over when the backboard is positioned on a surface so the second face faces the surface.

Other features of the present invention will be in part apparent and in part pointed out hereinafter.

BRIEF DESCRIPTION OF THE DRAWINGS

Corresponding reference characters indicate corresponding parts throughout the several views of the drawings.

DETAILED DESCRIPTION OF THE PREFERRED EMBODIMENT

Figure 1:
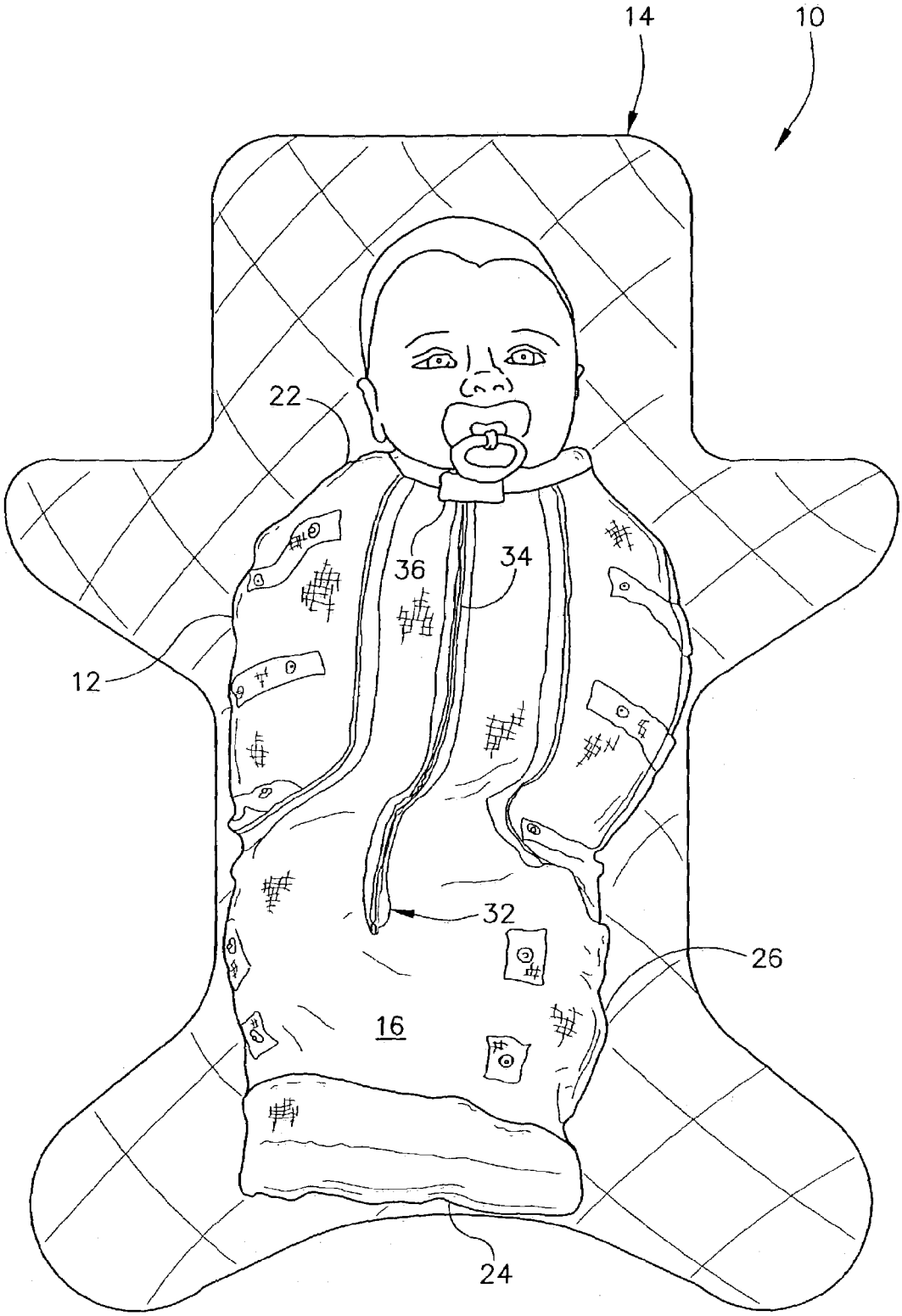
FIG. 1 is a front elevation of a garment of the present invention having a baby swaddled therein.
Figure 2:
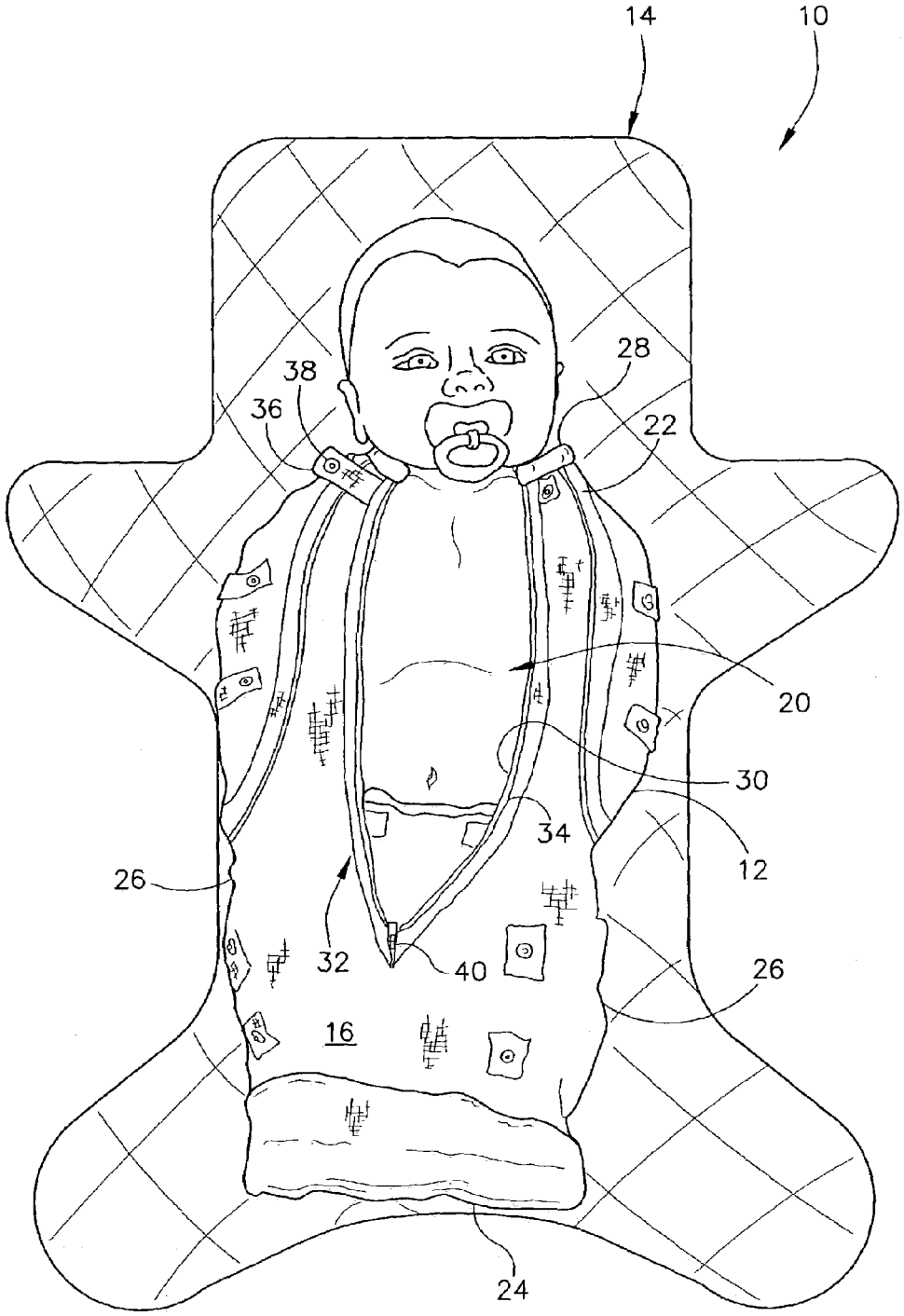
FIG. 2 is a front elevation of the garment with a longitudinal opening in an open position.

Referring now to the drawings and in particular to FIGS. 1 and 2, a garment for swaddling a baby is designated in its entirety by the reference numeral 10. The garment 10 generally comprises an elongate shell 12 for swaddling the baby and a backboard assembly, generally designated by the reference numeral 14, attached to the shell for preventing the baby from rolling over. The elongate shell 12 has an outer surface 16 and an inner surface 18 (FIG. 3) opposite the outer surface defining an interior volume, generally designated by the reference numeral 20, sized and shaped for receiving the arms, legs and trunk of the baby. The shell 12 also has a head end 22, a foot end 24 opposite the head end, and lateral sides 26 extending between the head end and the foot end. The shell 12 has a neck opening 28 at the head end 22 for receiving a neck of the baby and a longitudinal opening 30 extending from the neck opening for providing access to the interior volume 20 of the shell. The longitudinal opening 30 has an open position as illustrated in FIG. 2 for inserting the baby into the interior volume 20 and removing the baby from the volume, and a closed position as illustrated in FIG. 1 for retaining the baby in the interior volume. A closure, generally designated by the reference numeral 32, is positioned along the longitudinal opening 30 for selectively closing the longitudinal opening and securing the baby inside the interior volume 20 of the shell 12.

Although the longitudinal opening 30 and the closure 32 may extend along other faces of the elongate shell 12 without departing from the scope of the present invention, in one embodiment the opening and the closure extend along the front of the shell as shown in FIG. 1. Further, although the closure 32 may have other configurations without departing from the scope of the present invention, in one embodiment the closure includes a conventional zipper 34 and a neck strap 36 adjacent the neck opening 28. The neck strap 36 includes a snap fastener 38 for releasably fastening the strap across the longitudinal opening 30 of the garment 10 to cover a zipper pull 40 of the zipper 34 when the opening is in the closed position. Other conventional closures (e.g., snaps, Velcro fasteners, ties, and hooks) are also contemplated for closing the longitudinal opening 30 of the shell 12.

Figure 3:
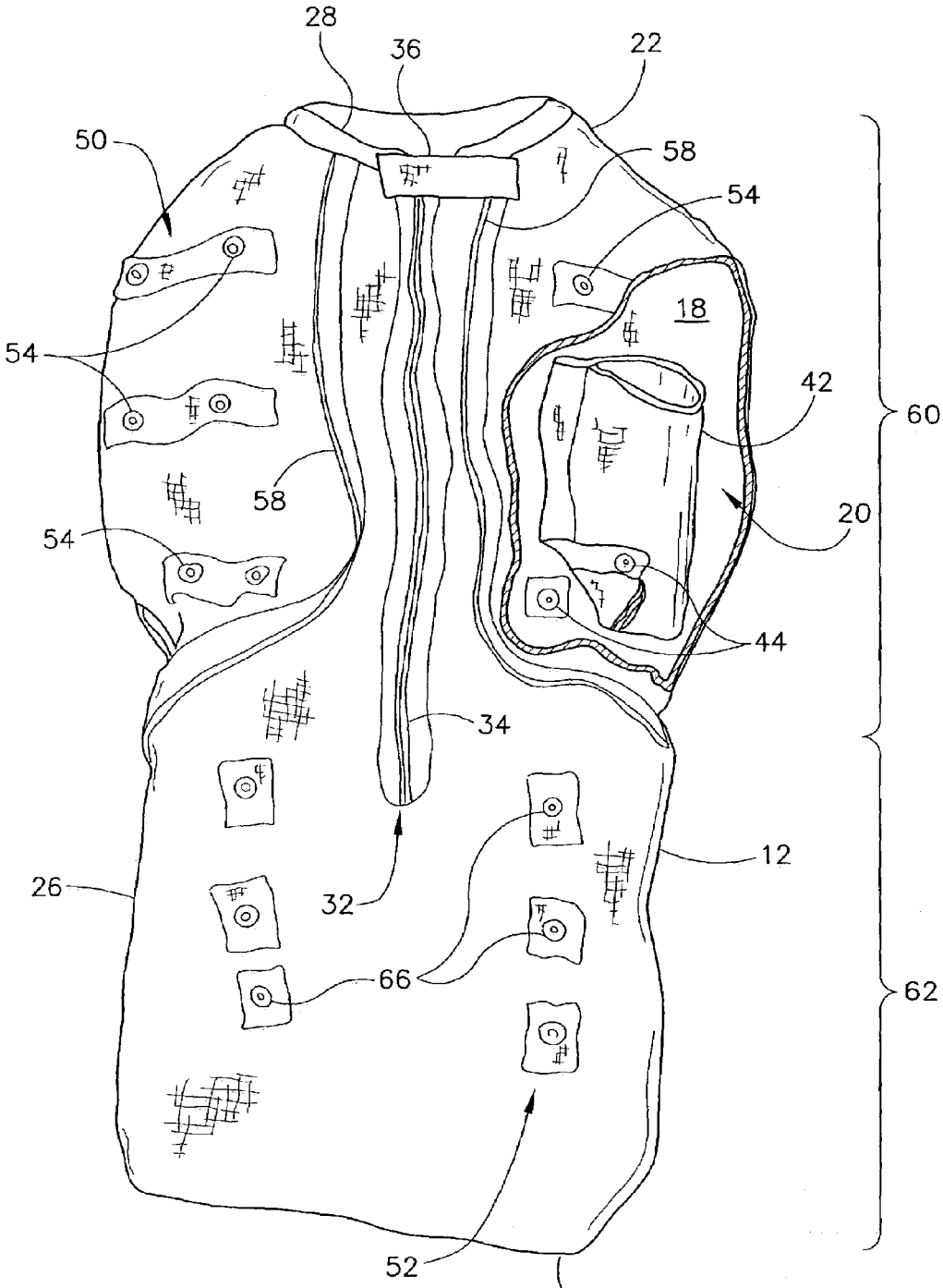
FIG. 3 is a front elevation of an elongate shell of the garment in partial section to illustrate interior features thereof.

As illustrated in FIG. 3, the elongate shell 12 includes a pair of restraints 42 (only one of which is shown) positioned inside the interior volume 20 of the shell 12 adjacent the lateral sides 26. Each restraint 42 is sized and shaped for receiving one of the arms of the baby to retain the respective arm in the interior volume 20 of the shell. Although it is envisioned that the restraints 42 may have other configurations without departing from the scope of the present invention, in one embodiment each restraint is tubular. Further, it is envisioned that the lower end of each restraint 42 may be open or closed without departing from the scope of the present invention. Still further, it is envisioned that each restraint may be releasably or permanently attached to the inner surface 18 of the shell 12 without departing from the scope of the present invention. In one embodiment, the restraints 42 are fastened to the inner surface 18 of the elongate shell 12 with snap fasteners 44.

Figure 4:
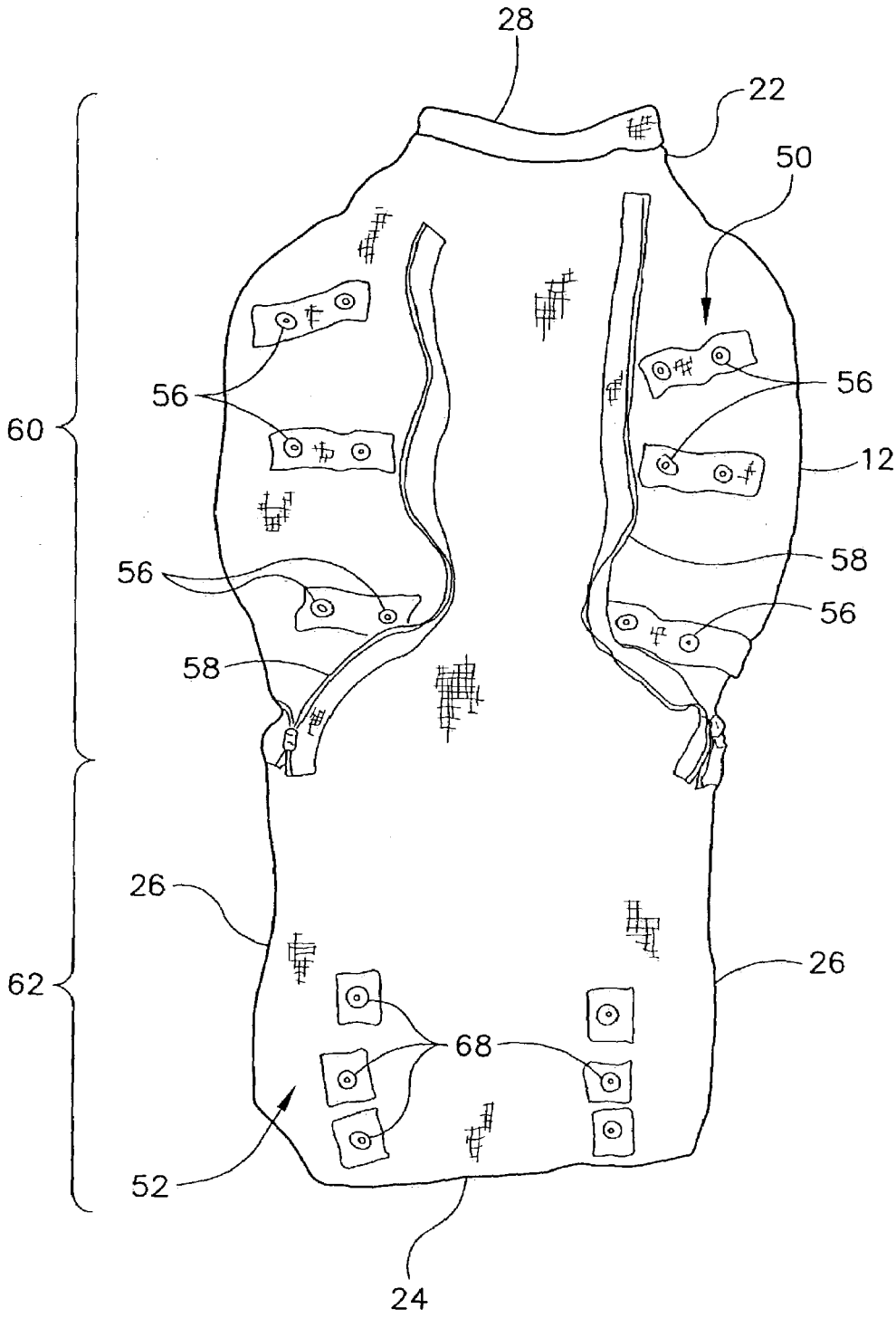
FIG. 4 is a rear elevation of the elongate shell.

As illustrated in FIGS. 3 and 4, the elongate shell 12 also includes adjustment elements, generally designated by the reference numerals 50 and 52, disposed along the shell for adjusting the size and/or shape of the interior volume 20 of the shell 12. The adjustment elements 50, 52 allow the garment 10 to be adjusted to fit babies of differing sizes and shapes and allow the interior volume 20 of the shell 12 to be adjusted to fit a baby as it grows. In one embodiment, the first set of adjustment elements 50 is positioned along the lateral sides 26 of the shell 12 for adjusting a girth of the shell to accommodate babies of differing sizes, and the second set of adjustment elements 52 is positioned at the foot end 24 of the shell for adjusting a length of the shell to accommodate babies of different lengths.

The first set of adjustment elements 50 include several fasteners arranged in longitudinal rows along the lateral sides 26 of the shell 12. Although other fasteners may be used without departing from the scope of the present invention, in one embodiment the fasteners include two rows of male snap fasteners 54 arranged on a front of the shell 12, and two rows of female snap fasteners 56 arranged on a back of the shell. In addition, the adjustment elements 50 may include a zipper 58 extending along each lateral side 26 of the shell 12. The rows of male snap fasteners 54 and female snap fasteners 56 may be snapped together to reduce the size of the shell 12 as illustrated in FIG. 2. Similarly, the fasteners 54, 56 may be disengaged to increase the girth of the shell 12 to accommodate babies as they grow. The material between the snapped male and female fasteners 54, 56 may be folded inside the interior volume 20 of the shell 12 before the fasteners are connected. The girth of the interior volume 20 of the shell 12 changes depending on which male and female snap fasteners 54, 56 are connected. For example, the outer-most fasteners 54, 56 on only one side 26 of the shell 12 may be connected to slightly reduce the shell girth, or the inner female fasteners may be connected to the outer male fasteners on both sides of the shell for a greater reduction in girth, or the inner-most fasteners on each side of the shell may be connected for an even greater reduction in girth. Other types of adjustment elements 50 besides snaps and zippers (e.g., Velcro.RTM. fasteners, hooks, ties and hooks) are also contemplated as being within the scope of the present invention.

The elongate shell should be snug around the baby's arms and trunk to provide comfort but be looser around the legs to avoid causing hip dysplasia. The adjustment elements 50 extending along the lateral sides 26 of the shell 12 are only positioned along a body portion 60 of the shell adjacent the head end 22 for covering the arms and trunk of the baby. A leg portion 62 of the shell 12 adjacent the foot end 24 for covering the legs of the baby is substantially free of adjustment elements 50 for adjusting the girth of the garment. Consequently, the adjustment elements 50 permit the body portion 60 of the shell 12 to be sized and shaped for enclosing the arms and trunk of the baby and for holding the arms of the baby in close proximity to the trunk of the baby, but ensure the leg portion 62 of the shell is appropriately sized and shaped for providing the legs of the baby with sufficient space to permit the baby to flex and abduct its hips within the interior volume 20 of the shell 12.

The second set of adjustment elements 52 include multiple fasteners arranged across the leg portion 62 of the shell 12 to allow the foot end 24 to be rolled upwardly or downwardly (as shown in FIGS. 1–4) and fastened to the outer surface 16 to adjust a length of the shell. In one embodiment, the adjustment elements 52 include male snap fasteners 66 arranged along the front of the leg portion 62 and female snap fasteners 68 arranged along the back of the leg portion. When none of the snap fasteners are fastened (as shown in FIGS. 3 and 4), the shell 12 is at its maximum length. To shorten the shell, the leg portion 62 is rolled upward (as shown in FIGS. 1 and 2) and the male and female snap fasteners 66, 68, respectively, are connected to secure the leg portion 62 in a shortened position. In one embodiment, the shell 12 includes three pairs of male snap fasteners 66 on the front of the leg portion 62 and three pairs of female snap fasteners 68 on the back of the leg portion, providing three shortened positions and allowing the elongate shell 12 to be adjusted to four different lengths.

In one embodiment, the shell 12 is formed from an elastic material, such as a material comprising spandex fibers. Other materials exhibiting similar characteristics are also contemplated as being within the scope of the present invention. Further, the material used to form the shell 12 is preferably breathable to allow the baby to regulate its temperature without becoming overly hot or cold.

Figure 5:
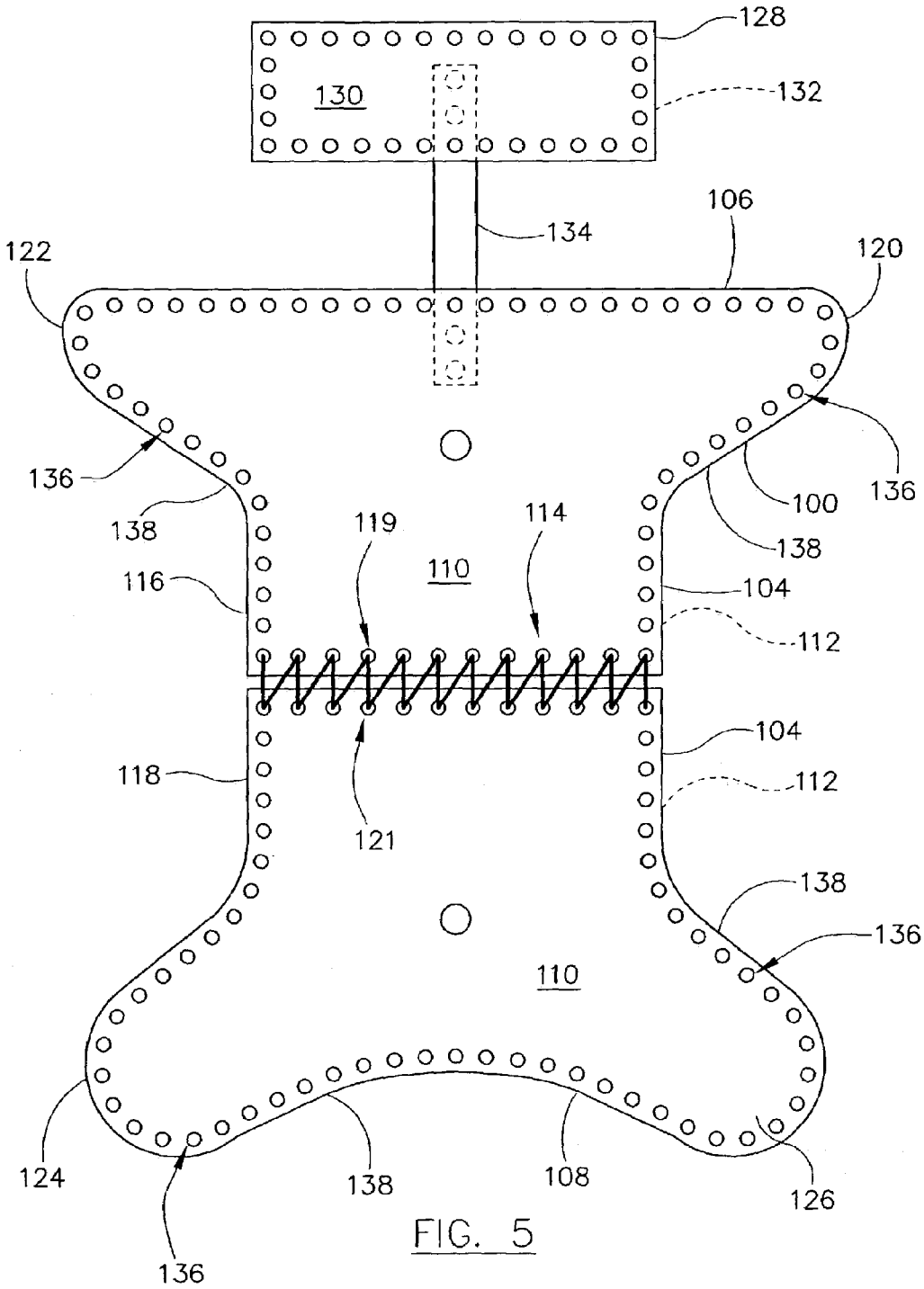
FIG. 5 is a front elevation of a backboard of the garment of the present invention.
Figure 7:
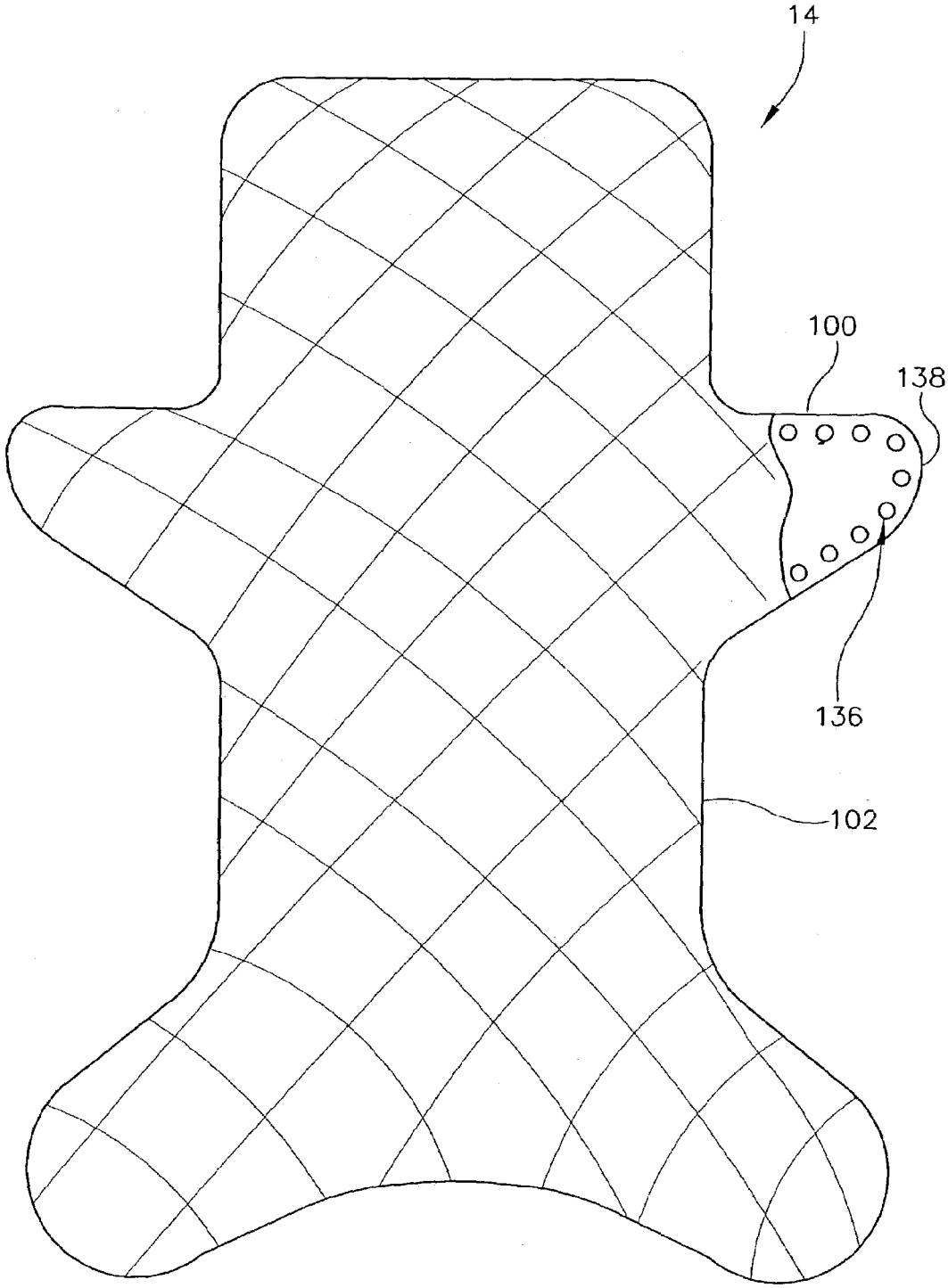
FIG. 7 is a front elevation of a backboard assembly of the present invention in partial section to illustrate interior features thereof.

As illustrated in FIG. 7, the backboard assembly 14 includes a backboard 100 and a cover 102. As shown in FIG. 5, the backboard 100 includes an elongate body 104 for supporting the trunk of the baby when the baby is swaddled within the elongate shell 12 (FIGS. 3 and 4). In one embodiment, the elongate body 104 is formed from a generally rigid material, such as plastic (e.g. Plexiglas®) or wood. The elongate body 104 extends between a head end 106 and a foot end 108 opposite the head end, and has a first or front face 110 and a second or rear face 112 opposite the first face. Either of the head end 106 and the foot end 108 may be referred to herein as a first and/or a second end. In one embodiment, the elongate body 104 includes a flexible hinge, generally designated by the reference numeral 114, between the head end 106 and the foot end 108. The hinge 114 allows selective adjustment of an angle between an upper portion 116 of the elongate body 104 and a lower portion 118 of the body to facilitate positioning the baby within the elongate shell 12 when the backboard assembly 14 is attached to the shell. Although other hinge types and configurations may be used without departing from the scope of the present invention, in one embodiment a plurality of openings, generally referred to by the reference numeral 119, within the upper portion 116 are stitched together with a plurality of openings, generally referred to by the reference numeral 121, within the lower portion 118 to form the flexible hinge 114.

As further illustrated in FIG. 5, a plurality of extensions 120, 122, 124, 126 extend generally laterally from the elongate body 104 for preventing the baby from rolling over when the baby is swaddled within the elongate shell 12 (FIGS. 1–4) and the backboard assembly 14 is attached to the shell. Although other configurations for the extensions 120, 122, 124, 126 may be used without departing from the scope of the present invention, in one embodiment a first pair of extensions 120, 122 extend generally laterally away from each other at the head end 106 of the body 104, and a second pair of extensions 124, 126 extend generally laterally away from each other at the foot end of the body 104. Additionally, although other angles of any and all of the extensions 120, 122, 124, 126 with respect to the elongate body 104 may be used without departing from the scope of the present invention, in one embodiment the extensions are generally planer with the body. Furthermore, although the extensions 120, 122, 124, 126 are illustrated herein as an integral portion of the elongate body 104, any or all of the extensions may be a separate component attached to the body (whether such extension is formed from the same or a different material as the body) without departing from the scope of the present invention. Still further, although the backboard 100 is described and illustrated herein as having four extensions 120, 122, 124, 126, the backboard may include any number of extensions without departing from the scope of the present invention. Any of the extensions 120, 122, 124, 126 may be referred to herein as a first extension and/or a second extension.

In one embodiment, a headboard 128 extends from the head end 106 of the elongate body 104 for supporting the head of the baby when the baby is swaddled within the elongate shell 12. The headboard 128 has a first or front face 130 and a second or rearward face 132 opposite the first face. Although the headboard 128 may be formed from any suitable material (whether such material is the same material as the elongate body), in one embodiment the headboard 128 is formed from a generally rigid material, such as plastic (e.g., Plexiglas®) or wood. Additionally, although other attachments are envisioned within the scope of the present invention, in one embodiment a metal bar 134 provides the attachment between the headboard 128 and the elongate body 104. In one embodiment, the metal bar 134 is generally flexible to allow selective adjustment of an angle of the headboard 128 with respect to the elongate body 104. The metal bar 134 may be connected to the headboard 128 and the body 104 using any suitable fasteners (e.g., rivets, adhesive, or threaded fasteners). In an alternative embodiment, a flexible hinge (not shown) is provided between the headboard 128 and the elongate body to allow selective adjustment of an angle between the headboard 128 and the elongate body 104. Although the headboard 128 is illustrated herein as a separate component attached to the elongate body 104, the headboard 128 may be an integral portion of the body without departing from the scope of the present invention.

Figure 6:
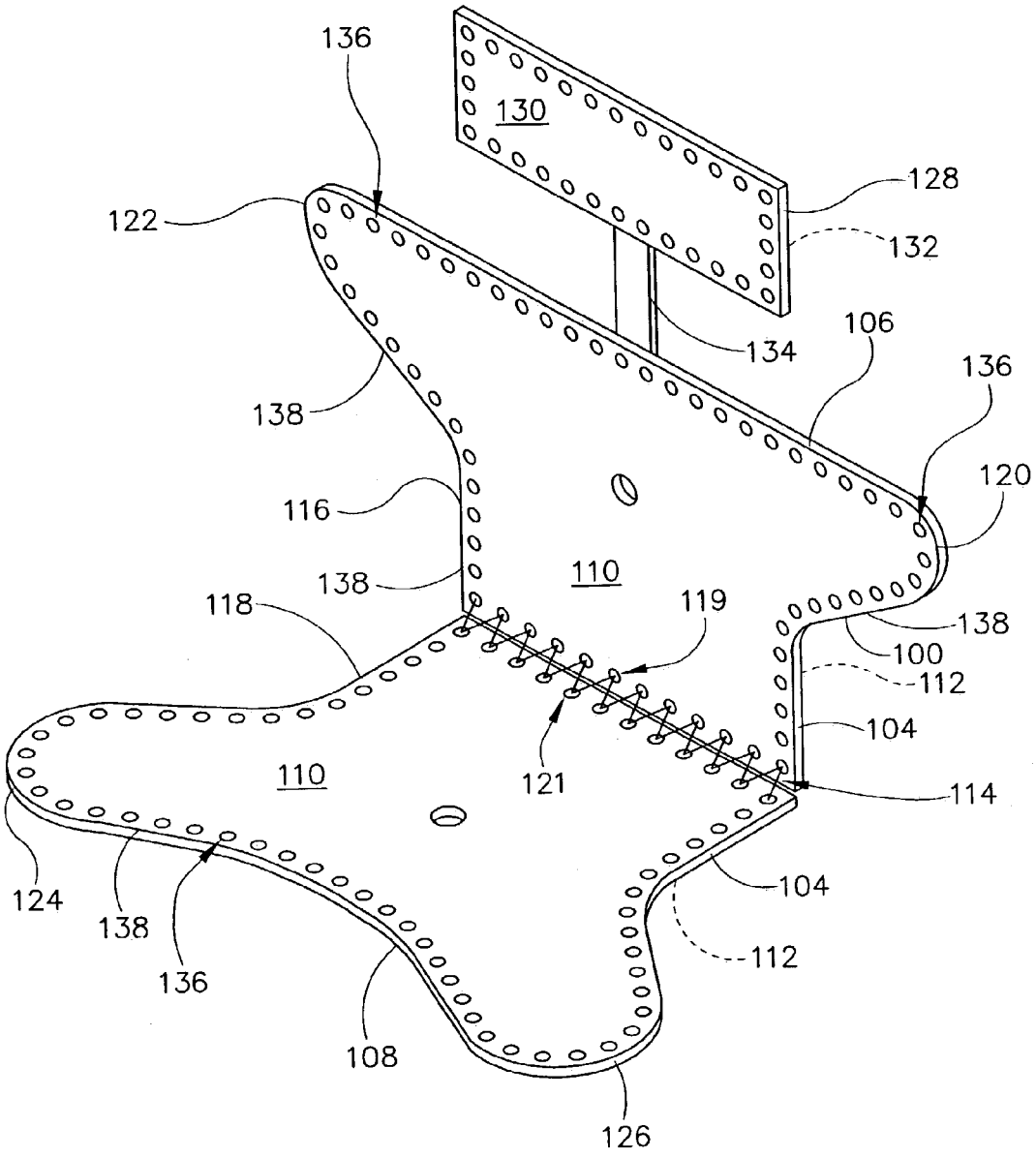
FIG. 6 is a perspective of the backboard in a partially folded configuration.

As is illustrated in FIG. 7, the cover 102 surrounds the backboard 100 so at least a portion of the first face 110 of the elongate body 104 is substantially covered. In one embodiment, the cover 102 substantially covers the entire backboard 100. As illustrated in FIGS. 1 and 2, the backboard assembly 14 is attached to the elongate shell 12 such that the first face 110 of the body 104 faces the shell 12, and such that the head end 106 of the body is generally adjacent the head end 22 of the shell and the foot end 108 of the body is generally adjacent the foot end 24 of the shell. In one embodiment, the backboard assembly 14 is releasably attached to the elongate shell 12 with releasable fasteners such as hook and loop fasteners. The backboard assembly 14 may be attached to the elongate shell 12 using any suitable releasable or permanent attachment. However, as illustrated in FIGS. 5 and 6, in the exemplary embodiment the backboard 100 includes a plurality of openings, generally referred to by the reference numeral 136, within the body 104 adjacent a peripheral edge 138 of the body for stitching the backboard 100 to the cover 102, the elongate shell 12, or both. For example, in one embodiment, the backboard 100 is stitched to the cover 102 using the openings 136, and the cover is separately attached to the elongate shell 12 using any suitable attachment. In another embodiment, the backboard 100 is stitched to the elongate shell 12 using the openings 136 and the cover 102 is not separately attached to the shell. In yet another embodiment, the backboard 100 is stitched to both the cover 102 and the elongate shell 12 using the openings 136. Although other shapes are envisioned for the openings 136 without departing from the scope of the present invention, in one embodiment the openings 136 are generally circular.

The cover may be formed from any suitable material, for example cotton. In one embodiment, the cover 102 is formed from a cushioned material (e.g., cotton batting) to provide a cushion between the backboard 100 and the baby when the baby is swaddled within the elongate shell 12 and the backboard assembly 14 is attached to the shell. More specifically, the cover 102 may cushion the trunk of the baby from the first face 110 of the elongate body 104 and may cushion the head of the baby from the first face 130 of the headboard 128. In another embodiment, a cushion (not shown) is positioned between the cover 102 and the backboard 100 to cushion the baby, and more specifically cushion the baby's head from the headboard first face 130 and cushion the baby's trunk from the body first face 110. In an alternative embodiment, the cover 102 does not cover the headboard 128 and a separate cover (not shown) covers the headboard 128. In such an alternative embodiment, the separate headboard cover may be formed from a cushioned material and/or may include a cushion (not shown) positioned between the headboard cover and the headboard first face 130 to cushion the baby's head from the headboard first face.

As illustrated in FIGS. 1 and 2, to use the garment 10, the baby is placed in the interior volume 20 of the elongate shell 12 and each arm of the baby is slipped into one of the restraints 42 to thereby secure the arm in the shell and to retain the respective arm in the interior volume 20 of the shell. The baby is positioned within the interior volume 20 of the shell 12 such that the first face 110 of the elongate body 104 faces the baby's trunk and the first face 130 of the headboard 128 faces the baby's head. To facilitate positioning the baby within the elongate shell comfortably, the upper portion 116 of the backboard elongate body 104 may be angled with respect to the body lower portion 118 using the flexible hinge 114. A girth of the shell 12 is adjusted by fastening the appropriate combination of fasteners 54, 56 so that when the shell is wrapped taut around the baby without stretching the shell, the longitudinal opening 30 of the shell has a width selected to apply a predetermined approximate pressure to the baby when the longitudinal opening is closed. Preferably, this pressure is as small as needed to calm the baby, yet does not interfere with breathing. Once the girth of the shell 12 is so adjusted, the longitudinal opening 30 is closed by zipping the zipper 34 to secure the shell around the baby. When the longitudinal opening 30 is closed, the shell supplies a comforting pressure to the arms and trunk of the baby. The length of the shell 12 may also be adjusted to correspond to a length of the trunk and legs of the baby as explained above.

When the longitudinal opening 30 is closed and the baby is swaddled within the elongate shell 12, the elongate body first face 110 faces the baby and the backboard elongate body 104 generally supports the trunk of the baby. Additionally, the headboard first face 130 faces the baby and the headboard generally supports the baby's head. The baby and the garment 10 can then be laid on an external surface so the baby's back faces the external surface, and more specifically so the second face 112 of the backboard elongate body 104 faces the external surface. When the baby is swaddled within the garment 10, the extensions 120, 122, 124, 126 prevent the baby from rolling over onto its stomach, and more specifically prevent the baby from rolling over into a position wherein it faces the external surface, which may cause suffocation and death. Additionally, the extensions 120, 122, 124, 126 decrease the likelihood of a parent or guardian laying the baby on its stomach or side when the baby is swaddled within the garment 10.

Although the backboard assembly 14 is herein described and illustrated as a combination of a backboard 100 and a cover 102, in one embodiment the backboard assembly does not include a cover, and may or may not include a cushion positioned between the backboard and the elongate shell 12. Additionally, in such an embodiment the backboard 100 may be releasably attached to the elongate shell 12.

The above-described garment is cost-effective and reliable for swaddling a baby and preventing the baby from lying on the baby's stomach. More specifically, when the baby is swaddled within a garment and laying on the baby's back, a backboard having a plurality of lateral extensions prevents the baby from rolling over onto the baby's stomach, which may cause suffocation and death. Additionally, the garment may decrease the likelihood of a parent or guardian laying the baby on the baby's stomach or side, and may increase the portability and ease placement of the baby within a home environment.

Although the backboard assembly is herein described and illustrated in association with the exemplary elongate shell, and more specifically in association with an elongate shell for swaddling a baby, it should be understood that the backboard assembly may generally be used in association with any garment to prevent a baby from rolling over. Accordingly, practice of the present invention is not limited to the exemplary elongate shell or other garments for swaddling a baby.

When introducing elements of the present invention or the preferred embodiment(s) thereof, the articles "a", "an", "the" and "said" are intended to mean that there are one or more of the elements. The terms "comprising", "including" and "having" are intended to be inclusive and mean that there may be additional elements other than the listed elements.

As various changes could be made in the above constructions without departing from the scope of the invention, it is intended that all matter contained in the above description or shown in the accompanying drawings shall be interpreted as illustrative and not in a limiting sense.

What is claimed is:

1. A garment for swaddling a baby comprising:

an elongate shell having an outer surface, and an inner surface opposite the outer surface defining an interior volume for receiving the arms, legs, and trunk of a baby therein, said shell having a head end, a foot end opposite the head end, lateral sides extending between the head end and the foot end, a front corresponding to a front of the baby when received within the interior volume of the shell, a back opposite the front, and a neck opening at the head end for receiving a neck of the baby; and a backboard attached to the back of the elongate shell between the head end and the foot end for preventing the baby from rolling over when the baby is swaddled within the elongate shell, said backboard comprising an elongate body for supporting a trunk of the baby, said body having a first face facing the baby when the baby is swaddled within the elongate shell, a second face opposite the first face, and a plurality of openings within the elongate body adjacent a peripheral edge of the body for attaching the backboard to a cover.

2. A backboard for preventing a baby from rolling over when the baby is swaddled within a garment, said backboard comprising:

an elongate body extending between a head end and a foot end opposite the head end, said body having a first face and a second face opposite the first face;

a plurality of openings within the elongate body adjacent a peripheral edge of the body for attaching the backboard to a cover, said body being attachable to the garment so the body generally supports a trunk of the baby and the first face faces the baby when the baby is swaddled within the garment;

a flexible hinge positioned on the body between the head end and the foot end for facilitating positioning the baby within the garment; and an extension extending generally laterally from the body for preventing the baby from rolling over when the backboard is positioned on a surface so the second face faces the surface.

3. A backboard in accordance with claim 2 wherein said extension is a first extension extending from the body at the head end, said backboard further comprising a second extension at the head end of the body extending generally away from the first extension.

4. A backboard in accordance with claim 2 wherein said extension is a first extension extending from the body at the foot end, said backboard further comprising a second extension at the foot end of the body extending generally away from the first extension.

5. A backboard in accordance with claim 2 further comprising a headboard extending from the head end of the body for supporting a head of the baby when the baby is swaddled within the garment.

6. A backboard in accordance with claim 5 further comprising a hinge coupled between the headboard and the elongate body for allowing selective adjustment of an angle of the headboard with respect to the elongate body.

7. A backboard in accordance with claim 5 wherein the headboard has a first face facing the head of the baby when the baby is swaddled within the garment and a second face opposite the first face, said headboard having a cushion positioned on the headboard first face for cushioning the head of the baby.

8. A backboard in accordance with claim 2 further comprising a cushion positioned on the first face of the elongate body for cushioning the trunk of the baby.

9. A backboard in accordance with claim 2 wherein the extension extends generally parallel to the elongate body.

10. A backboard for preventing a baby from rolling over when the baby is swaddled within a garment, said backboard comprising:

a rigid elongate body extending between a head end and a foot end opposite the head end, said body having a first face, a second face opposite the first face, and a plurality of openings within the elongate body adjacent a peripheral edge of the body, for attaching the backboard to a cover, said body being attachable to the garment so the body generally supports a trunk of the baby and the first face faces the baby when the baby is swaddled within the garment;

a flexible hinge positioned on the body between the head end and the foot end for facilitating positioning the baby within the garment;

a headboard extending from the head end of the body for supporting a head of the baby when the baby is swaddled within the garment, said headboard having a first face facing the head of the baby when the baby is swaddled within the garment, a second face opposite the first face, and a cushion positioned on the headboard first face for cushioning the head of the baby; and an extension extending generally laterally from the body for preventing the baby from rolling over when the backboard is positioned on a surface so the second face faces the surface.

* * * * *